US008413804B2

(12) United States Patent
Koester

(10) Patent No.: US 8,413,804 B2
(45) Date of Patent: Apr. 9, 2013

(54) CIGARETTE PAPER PACK

(75) Inventor: Klaus Koester, Reichshof (DE)

(73) Assignee: Gizeh Raucherbedarf GmbH, Gummersbach (DE)

( * ) Notice: Subject to any disclaimer, the term of this patent is extended or adjusted under 35 U.S.C. 154(b) by 0 days.

(21) Appl. No.: 13/321,551

(22) PCT Filed: May 3, 2010

(86) PCT No.: PCT/EP2010/055981

§ 371 (c)(1),
(2), (4) Date: Nov. 21, 2011

(87) PCT Pub. No.: WO2010/136303

PCT Pub. Date: Dec. 2, 2010

(65) Prior Publication Data

US 2012/0103842 A1 May 3, 2012

(30) Foreign Application Priority Data

May 28, 2009 (DE) ..... 10 2009 025 882

(51) Int. Cl.
*B65D 85/10* (2006.01)

(52) U.S. Cl. ..... 206/256; 206/1.5; 206/449

(58) Field of Classification Search ..... 206/1.5, 206/242, 265, 266, 268, 271, 273, 449, 256; 229/120.16, 148–151; 221/47, 63, 305
See application file for complete search history.

(56) References Cited

U.S. PATENT DOCUMENTS

| | | | | | |
|---|---|---|---|---|---|
| 2,331,754 | A * | 10/1943 | Wohlers | 229/148 |
| 3,357,630 | A * | 12/1967 | Michelitsch | 229/148 |
| 5,967,311 | A * | 10/1999 | Ruppert et al. | 206/256 |
| 6,736,309 | B1 * | 5/2004 | Westerman et al. | 229/149 |
| 2005/0173291 | A1 * | 8/2005 | Specker et al. | 206/536 |
| 2006/0243610 | A1 | 11/2006 | Chamami | |
| 2007/0221528 | A1 * | 9/2007 | Bobe et al. | 206/494 |

FOREIGN PATENT DOCUMENTS

| | | | |
|---|---|---|---|
| DE | 295 02 062 | U1 | 6/1996 |
| DE | 297 18 677 | U1 | 2/1998 |
| DE | 203 17 744 | U1 | 4/2004 |
| DE | 10 2006 009 207 | A1 | 8/2007 |
| EP | 1 323 635 | A1 | 7/2003 |
| FR | 2 821 526 | A1 | 9/2002 |
| WO | WO 2006/111956 | A2 | 10/2006 |

* cited by examiner

*Primary Examiner* — Luan K Bui
(74) *Attorney, Agent, or Firm* — Norman B. Thot

(57) ABSTRACT

A cigarette paper pack for storing and supplying cigarette paper sheets for the self-rolling of cigarettes includes a container. The container comprises an insertion opening, the insertion opening comprising a latching protrusion, and at least one stack of cigarette paper sheets. An uppermost layer of the at least one stack of cigarette paper sheets extends through at least one removal opening assigned thereto in a wall. The wall is configured to form an upper side of the container during the use thereof. A recloseable cover is connected to the container. The reclosable cover comprises an insertion tab which comprises a latching opening. The reclosable covering is configured to be pivoted about a periphery so as to form a hinge axis. The insertion tab is configured to be inserted into the insertion opening. The latching opening and the latching protrusion are configured to form a latching device.

9 Claims, 4 Drawing Sheets

CIGARETTE PAPER PACK

CROSS REFERENCE TO PRIOR APPLICATIONS

This application is a U.S. National Phase application under 35 U.S.C. §371 of International Application No. PCT/EP2010/055981, filed on May 3, 2010 and which claims benefit to German Patent Application No. 10 2009 025 882.5, filed on May 28, 2009. The International Application was published in German on Dec. 2, 2010 as WO 2010/136303 A1 under PCT Article 21(2).

FIELD

The present invention provides a cigarette paper pack for storing and supplying cigarette paper sheets for the self-rolling of cigarettes, having a container, which contains at least one stack of cigarette paper sheets, of which the uppermost layer extends through a removal opening, assigned to the stack, in the wall which, during intended use, forms the upper side of the container, and having a recloseable cover, which has a periphery connected to the container such that it can be pivoted about a hinge axis, and which has, on a free periphery, an insertion tab, which can be inserted into an insertion slot in the container.

BACKGROUND

DE 203 17 744 U1 describes a cigarette paper pack where the cover conceals the removal opening(s) (in the case of a plurality of stacks of cigarette paper sheets arranged one beside the other in the container) on the upper side of the container when it is located in the strong-closed state. The stack or the stacks usually contain a multiplicity of sheets, each folded about a folding line, the sheet therefore comprises two limbs arranged one above the other. In the stack, the limbs of successive sheets are oriented in opposite directions and the limbs of adjacent sheets are folded one inside the other, so that the upper limb of a following sheet butts against the lower limb of a preceding sheet. The respectively upper limb of the uppermost sheet of the stack projects through the removal opening. The uppermost sheet can be drawn out thereby, wherein, as a result of the sheets being folded one inside the other, the uppermost sheet carries along the next-following sheet, and therefore the upper limb of the next-following sheet then projects out of the removal opening.

In the brand-new state, the cover is fixed in the closed state by an additional label and/or by being adhesively bonded to the container. For the purpose of opening the cover for the purpose of removing the first sheet, the label is torn open and/or the adhesive bonding is released or that part of the cover which provides the adhesive bonding is severed. DE 203 17 744 U1 describes that the cover of the cigarette paper pack has provided on it an insertion tab which can be pushed into an insertion opening provided in the container in order to prevent the situation where the cover springs open of its own accord, and in particular, the limbs of the sheets which project out of the removal openings being soiled or damaged.

It has been found in practice that the cover tends to spring open accidentally, in particular when the cigarette paper pack is a so-called double pack in which two stacks of cigarette paper sheets folded one inside the other are accommodated one beside the other and can be removed independently of one another through two parallel removal openings.

SUMMARY

An aspect of the present invention is to provide a remedy for the aforementioned disadvantages using the most straightforward measures possible. An additional alternative aspect is to provide a cigarette paper pack in which the cover is better secured so as to not spring open of its own accord.

In an embodiment, the present invention provides a cigarette paper pack for storing and supplying cigarette paper sheets for the self-rolling of cigarettes which includes a container. The container comprises an insertion opening, the insertion opening comprising a latching protrusion, and at least one stack of cigarette paper sheets. An uppermost layer of the at least one stack of cigarette paper sheets extends through at least one removal opening assigned to the respective at least one stack of cigarette paper sheets in a wall. The wall is configured to form an upper side of the container during the use thereof. A recloseable cover is connected to the container. The reclosable cover comprises an insertion tab which comprises a latching opening. The reclosable covering is configured to be pivoted about a periphery so as to form a hinge axis. The insertion tab is configured to be inserted into the insertion opening. The latching opening and the latching protrusion are configured to form a latching device.

BRIEF DESCRIPTION OF THE DRAWINGS

The present invention is described in greater detail below on the basis of embodiments and of the drawings in which.

DETAILED DESCRIPTION

In an embodiment of the present invention, latching means can, for example, be provided on the insertion tab and on the insertion slot so as to make it more difficult for the cover to swing open of its own accord. The latching means make it necessary for an additional force, which overcomes the latching action, to be applied so as to open the cover.

In an embodiment of the present invention, the latching means may, for example, comprise a latching opening provided in the insertion tab and a latching protrusion provided in the insertion slot.

In an embodiment of the cigarette paper pack according to the present invention, the insertion tab can, for example, be formed by a cover protrusion which is folded in the direction of the container about a first folding line, which runs along the free periphery, which extends parallel to the hinge axis.

When the cover extends over at least more or less the entire surface area of the upper side of the container, the insertion slot may be provided in the region of a second folding line of the container, the second folding line extending parallel to the free periphery.

In an embodiment of the present invention, the latching opening can, for example, be bounded on the cover side by the first folding line so that the latching protrusion extends in the insertion slot into the vicinity of the second folding line. This configuration makes it possible for both the latching opening and the latching protrusion to be produced by the material used for the cigarette paper pack being cut appropriately, which has the advantage that there is no need to fit additional parts for the purpose of forming the latching means. The cigarette paper pack according to the present invention thus does not involve higher production outlay than conventional cigarette paper packs. Like conventional cigarette paper packs, it may be produced from a single-piece blank made of thick paper or thin cardboard with a weight per unit area of approximately 120 to 200 g/m$^2$.

Since it is more difficult for the insertion tab to be inserted into the insertion opening when the insertion tab is deformed, it may, for example, be advantageous to reinforce the insertion tab, for example, when the blank has a relatively low weight per unit area.

Despite this reinforcement, the cigarette paper pack can be produced from a single-piece blank if, for example, the reinforcement is formed by a reinforcement tab which is folded over along a free periphery of the insertion tab. The reinforcement tab can then be adhesively bonded to the insertion tab on the rear side thereof.

The cigarette paper pack according to the present invention may be designed both as a so-called single pack, for example, merely a single cigarette paper stack of, for example, 50 cigarette paper sheets, or as a so-called double pack, for example, containing two stacks of cigarette paper sheets with their longitudinal sides arranged one beside the other.

Figure 1:
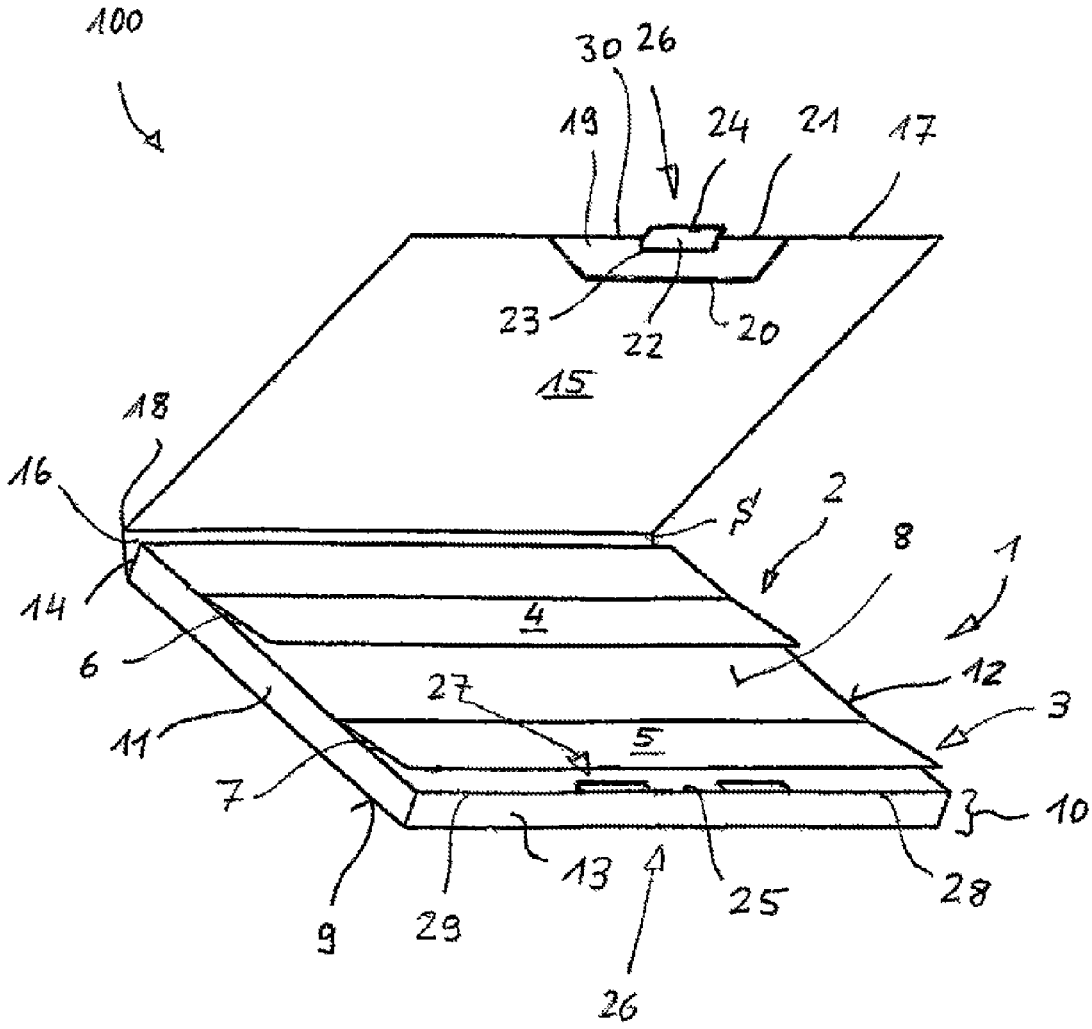
FIG. 1 shows a perspective illustration, as seen obliquely from the front, of a cigarette paper pack according to the present invention designed as a double pack, with the cover swung open.

The cigarette paper pack which is designated as a whole by 100 in FIG. 1 comprises a container 1 in the form of a flat cuboid, which contains two stacks 2, 3 of cigarette paper sheets, which are folded in the longitudinal direction and pushed alternately one inside the other in the lateral direction by way of the open limbs. Of the two stacks 2, 3, in each case only the uppermost limbs 4, 5 of the uppermost sheets of the two stacks 2, 3 can be seen. They project out of removal openings 6, 7 of the wall 8 of the container 1, the wall forming the upper side during intended use of the cigarette paper pack 100.

The plan view of the container 1, i.e., the outline of the wall 8 and of the base 9 located therebeneath, corresponds approximately to the outline of the two cigarette paper stacks 2, 3 adjacent to one another, and the height 10 corresponds approximately to the height of a complete cigarette paper stack 2, 3.

In addition to the wall 8 and the base 9, the container 1 also comprises two relatively short side surfaces 11, 12 and two longer side surfaces 13, 14.

The cigarette paper pack 100 further comprises a cover 15, which is articulated on the base 9 via a narrow swing-action region 16 and is connected to the container 1 such that it can be swung about a hinge axis S. The cover 15 has a surface area which corresponds to that of the wall 9 or of the base.

An insertion tab 19 is provided on the free periphery 17 of the cover, this periphery being located opposite the periphery 18, which forms the hinge axis S, and running parallel to the hinge axis S. The insertion tab 19 extends symmetrically to the center, approximately over a third of the length of the free periphery 17, and is angled downward, approximately through 90°, from the cover 15. The downwardly directed, free periphery 20 is shorter than the connecting edge 21 to the cover 15, and therefore the insertion tab 19 tapers approximately conically downward, as seen in plan view, so as to facilitate the insertion operation. A latching opening 22 is provided along the connecting edge 21, symmetrically to the center. For this purpose, an incision 23 is introduced in the downward direction from the connecting edge 21, and parallel to the latter, and the part which is separated from the insertion tab 19 by the incision 23 is formed into an extension 24, which runs in the same plane as the cover 15.

The extension 24 thus projects beyond the free periphery 17 of the cover 15 and makes it easier for the cover to be manipulated, for example, for opening purposes.

The latching opening 22 and a latching protrusion 25 together form latching means 26. The latching protrusion 25 is provided symmetrically to the center of an insertion opening 27. The latter extends within the upper wall 8, parallel to the front upper edge 28 of the container, this upper edge being formed by a second folding line 29. The edge 28 and thus the second folding line 29, in the closed state of the cover, are closely adjacent to the free periphery 17 and to the connecting edge 21, which is formed by a first folding line. The insertion opening 27 is dimensioned so as to allow the insertion tab 19 to be inserted while the latching protrusion 25 is bent away elastically in the process. This latching protrusion latches into the latching opening 22 as soon as the cover 15 is fully closed, i.e., the underside thereof butts at least more or less against the upper side of the wall 8. The cover can then only be opened with the latching protrusion 15 being bent away elastically until it releases the latching opening 22.

Figure 2:
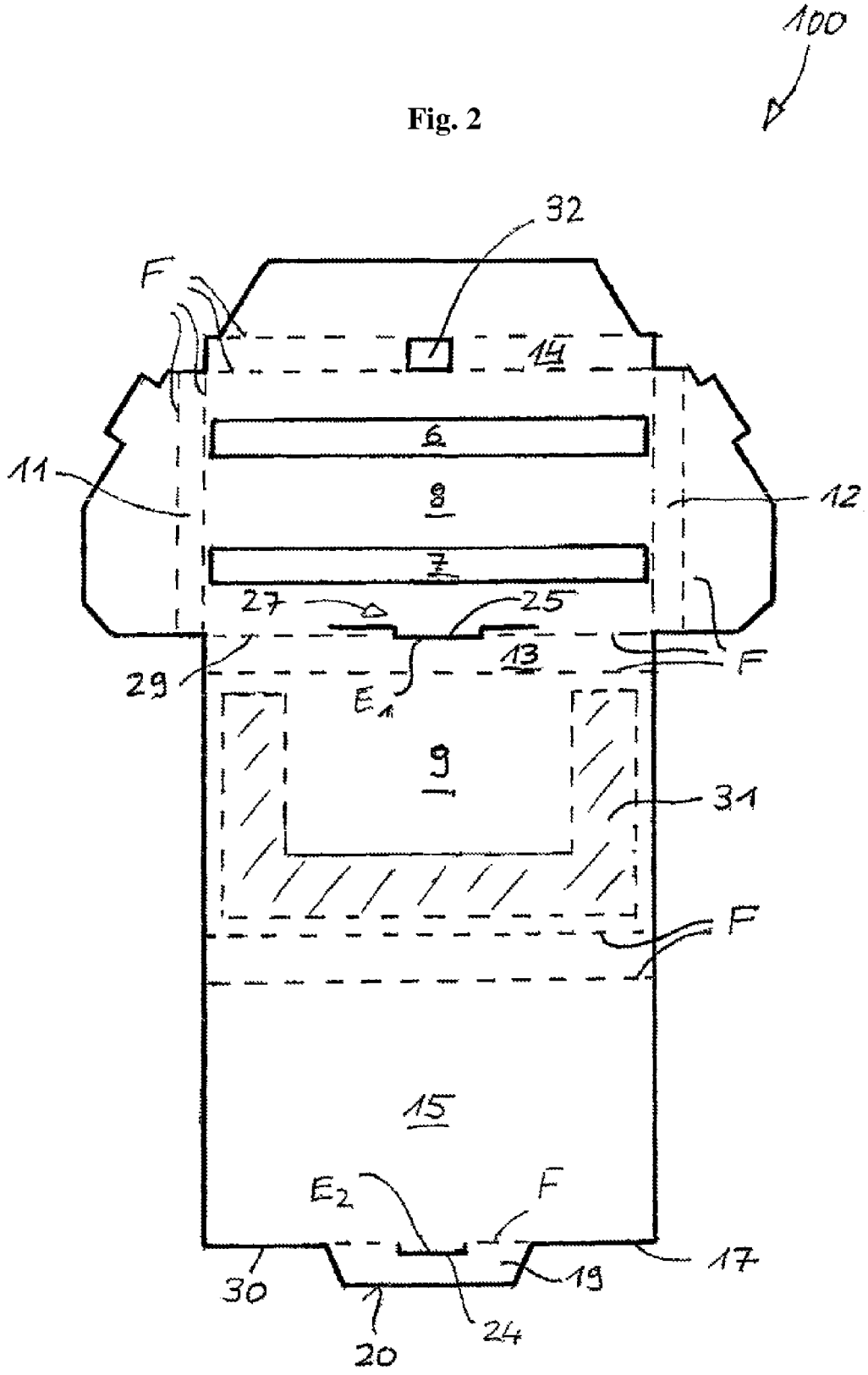
FIG. 2 shows a first exemplary embodiment of a blank from which the cigarette paper pack according to FIG. 1 can be produced by folding and adhesive bonding.

As can be seen, in particular, in FIG. 2, which shows a first exemplary embodiment of a blank of thin cardboard prior to being folded into the pack according to the present invention, it is possible for the pack, despite the additional latching means, to be produced from a single-piece blank by subsequent folding and adhesive bonding. The folding lines F, about which folding takes place through 90° in each case, are illustrated by dashed lines in FIG. 2. In order to fix the cigarette paper pack 100 in the folded state, a layer 31 of adhesive is applied to the upper side of the region forming the base 9. The additional latching means 26 form automatically, on account of the incisions $E_1$ and $E_2$, as the blank is being folded. The incision $E_1$ in the wall 8 comprises three regions: two outer regions, which are spaced apart from the folding line 29 by a distance equal to roughly the material thickness of the insertion tab 19, and a central region, which coincides with the folding line 29. The incision $E_2$ in the insertion tab 19 is offset in the direction of the free periphery 20 in relation to the folding line F, about which the insertion tab 19 is angled from the cover, by approximately the material thickness of the latching protrusion 25 and has a length which is slightly greater than the length of the latching protrusion 25.

As can also be seen from FIG. 2, a cutout 32 is located in the central region of the relatively long side surface 14. This cutout serves to form a window, through which what remains of the rear cigarette paper stack 2 according to FIG. 1 can be seen. A corresponding window for the front stack 3 according to FIG. 1 is not provided, nor is it necessary, since the user usually begins by removing the cigarette paper sheets of the front stack 3, and continues with removal from the rear stack 2 when the final sheet of the first stack has been removed.

Figure 3:
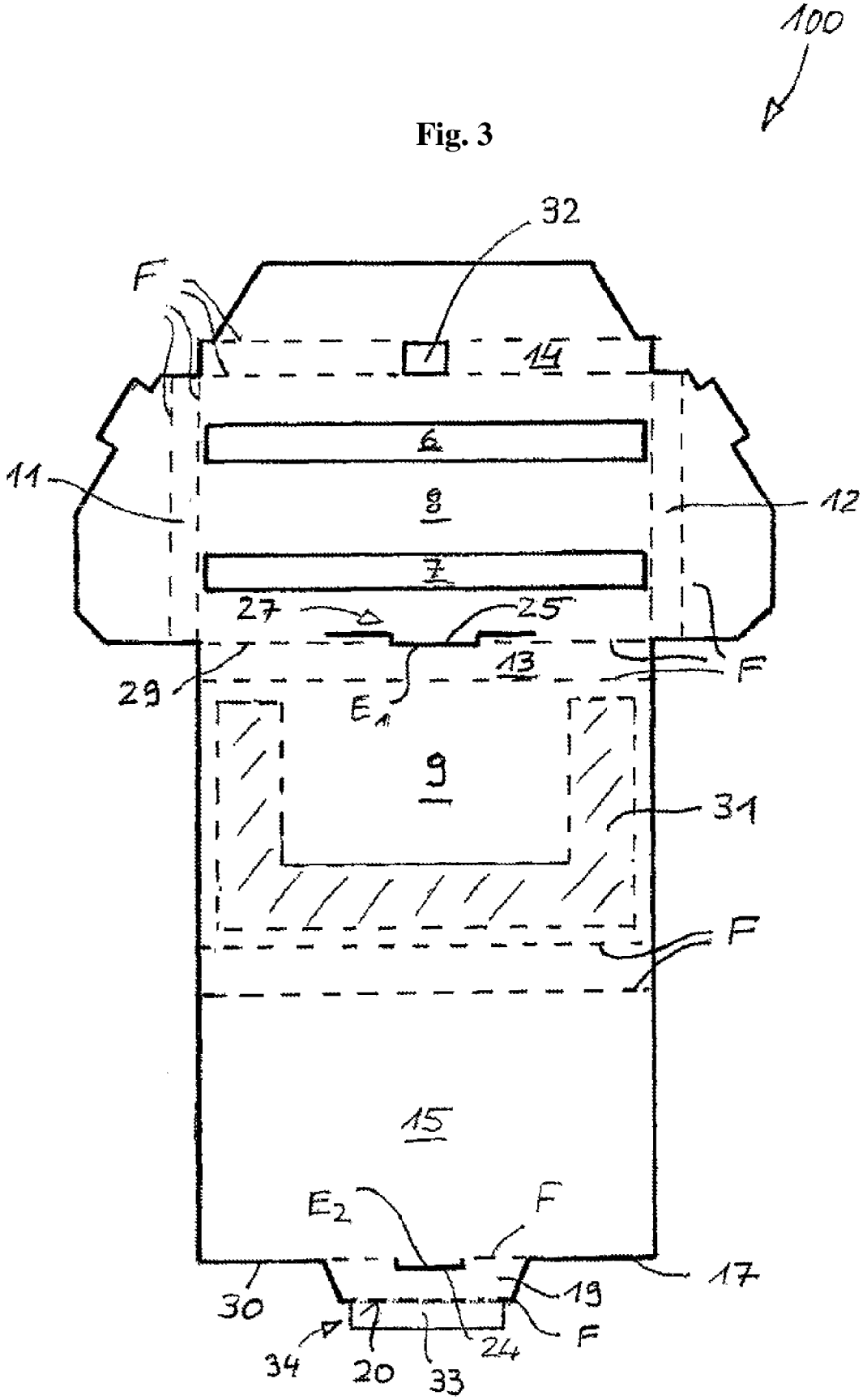
FIG. 3 shows a second exemplary embodiment of a blank from which the cigarette paper pack according to FIG. 1 can be produced by folding and adhesive bonding.

A second exemplary embodiment of a blank of thin cardboard prior to being folded into the pack according to the present invention is illustrated in FIG. 3. This second exemplary embodiment corresponds essentially to the first, and therefore, for the sake of avoiding repetition, reference is made to the description of FIG. 2. The only difference is that the free periphery 20 of the insertion tab 19 is now formed by a folding line F, from which a reinforcement tab 33 extends. This reinforcement tab is folded over toward the rear side of the blank, and is adhesively bonded to the insertion tab 19 so as to produce the pack. It thus forms a reinforcement 34 for the insertion tab 19.

Figure 4:
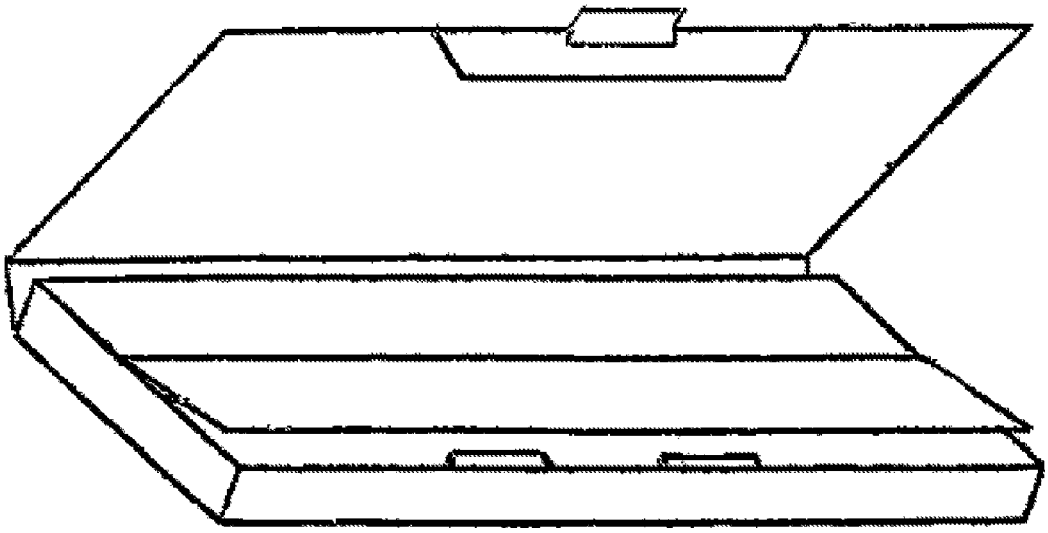
FIG. 4 shows an illustration corresponding to FIG. 1 of a cigarette paper pack according to the present invention designed as a single pack.

As already mentioned, the design of a cigarette paper pack according to the present invention can also used for single packs which contain just one stack of cigarette paper sheets. Such a cigarette paper pack is illustrated in FIG. 4. Since the construction and functioning thereof correspond with those of the double pack described and illustrated with reference to FIGS. 1, 2 and 3, the only exception being that the dimensions of the upper wall and the base are adapted to the single stack, reference is made, for the sake of avoiding repetition, to what has been said in relation to the double pack.

The present invention is not limited to embodiments described herein; reference should be had to the appended claims.

LIST OF DESIGNATIONS

100 Cigarette-paper pack
1 Container
2 Stack
3 Stack
4 Limb
5 Limb
6 Removal opening
7 Removal opening
8 Wall
9 Base
10 Height
11 Relative short side surface
12 Relative short side surface
13 Longer side surface
14 Longer side surface
15 Cover
16 Swing-action region
17 Free periphery
18 Periphery
19 Insertion tab
20 Free periphery
21 Connecting edge
22 Latching opening
23 Incision
24 Extension
25 Latching protrusion
26 Latching means
27 Insertion opening
28 Edge
29 Second folding line
30 First folding line
31 Layer of adhesive
32 Cutout
33 Reinforcement tab
34 Reinforcement
$E_1$, $E_2$ Incisions
F Folding lines
S Hinge axis

What is claimed is:

1. A cigarette paper pack for storing and supplying cigarette paper sheets for the self-rolling of cigarettes, the cigarette paper pack comprising:

a container comprising an insertion opening, the insertion opening comprising a latching protrusion, and at least one stack of cigarette paper sheets, an uppermost layer of the at least one stack of cigarette paper sheets extending through at least one removal opening assigned to the respective at least one stack of cigarette paper sheets in a wall, the wall being configured to form an upper side of the container during the use thereof; and a reclosable cover connected to the container, the reclosable cover comprising an insertion tab which comprises a latching opening, the reclosable cover being configured to be pivoted about a periphery of the reclosable cover so as to form a hinge axis, and the insertion tab being configured to be inserted into the insertion opening;

wherein, the latching opening and the latching protrusion are configured to form a latching device, wherein, the latching protrusion and the insertion opening are both provided within the wall, and wherein, to close the cigarette paper pack, the insertion tab is inserted into the insertion opening, thereby elastically bending the latching protrusion so that the latching protrusion latches into the latching opening when the reclosable cover is fully closed.

2. The cigarette paper pack as recited in claim 1, wherein the insertion tab is formed by a cover protrusion, the cover protrusion being folded in a direction of the container about a first folding line running along a free periphery and extending parallel to the hinge axis.

3. The cigarette paper pack as recited in claim 2, wherein the insertion opening is provided in a region of a second folding line of the container, the second folding line extending parallel to the free periphery.

4. The cigarette paper pack as claimed in claim 3, wherein the latching opening is bounded on a cover side by the first folding line, and the latching protrusion extends into a vicinity of the second folding line.

5. The cigarette paper pack as recited in claim 1, wherein the insertion tab further comprises a reinforcement.

6. The cigarette paper pack as recited in claim 5, wherein the reinforcement comprises a reinforcement tab, and the reinforcement is formed by the reinforcement tab being folded over along a free periphery of the insertion tab.

7. The cigarette paper pack as recited in claim 1, wherein the cigarette paper pack is provided from a single-piece blank made of a thick paper or a thin cardboard with a weight per unit area of about 120 to 200 g/m$^2$.

8. The cigarette paper pack as recited in claim 1, wherein the at least one stack of cigarette paper sheets is a single stack of cigarette paper sheets.

9. The cigarette paper pack as recited in claim 1, wherein the at least one stack of cigarette paper sheets is two more or less adjacent stacks of cigarette paper sheets extending parallel to each another in a longitudinal direction.

* * * * *